US006052839A

United States Patent [19]

Teskey

[11] Patent Number: 6,052,839

[45] Date of Patent: Apr. 25, 2000

[54] ANGLED WATER CLOSET FLANGE

[75] Inventor: James Teskey, Barrie, Canada

[73] Assignee: Canplas Industries Ltd., Barrie, Canada

[21] Appl. No.: 08/281,318

[22] Filed: Jul. 28, 1994

Related U.S. Application Data

[63] Continuation of application No. 08/023,836, Feb. 23, 1993, abandoned.

[51] Int. Cl.[7] ..... E03D 11/16

[52] U.S. Cl. ..... 4/252.5; 4/252.4

[58] Field of Search ..... 4/252.1, 252.4, 4/252.5, 252.6; 285/58, 179, 184

[56] References Cited

U.S. PATENT DOCUMENTS

| | | | |
|---|---|---|---|
| 206,421 | 7/1878 | Coleman | 34/197 |
| 310,298 | 1/1885 | McFarland | 285/58 |
| 903,280 | 11/1908 | Farrell | 285/298 |
| 990,646 | 4/1911 | Fisher | 285/56 |
| 1,091,697 | 3/1914 | O'Donnell | 285/58 |
| 1,379,141 | 5/1921 | Vasselli | 285/330 |
| 2,739,779 | 3/1956 | Krone et al. | 403/111 |
| 2,899,690 | 8/1959 | Clifford | 4/252.4 |
| 3,235,887 | 2/1966 | Clifford | 4/252.6 X |
| 3,775,780 | 12/1973 | McEwen | 4/252.4 |
| 3,846,851 | 11/1974 | Pepper | 4/252.4 |
| 3,967,836 | 7/1976 | Izzi, Sr. | 285/12 |
| 4,827,539 | 5/1989 | Kiziah | 4/252.4 |

FOREIGN PATENT DOCUMENTS

| | | | |
|---|---|---|---|
| 9002850 | 3/1990 | WIPO | 4/661 |
| 9219901 | 11/1992 | WIPO | 285/184 |

*Primary Examiner*—Robert M. Fetsuga

[57] ABSTRACT

An offset toilet flange for connecting an outlet of a toilet bowl with waste water drain conduit is shown. The toilet flange includes an outer flange having an upper surface and a lower surface. The outer flange has at least two generally opposed first apertures which extend through the flange between the upper surface and the lower surface for retaining fasteners for securing the flange to an underlying surface. At least a portion of the lower surface lies against the underlying surface. The flange also includes at least two second apertures extending from the lower surface to the upper surface for retaining fasteners connecting the flange to the toilet bowl. A seat is also provided for a toilet bowl seal, the seat being located inside of the flange and being circular in plan and inwardly curved in profile. A discharge tube extends outwardly from the seat at angle to an axis corresponding to the center of the seat in plan and the flange includes an outlet on the discharge for connecting to the waste water drain conduit.

9 Claims, 3 Drawing Sheets

ANGLED WATER CLOSET FLANGE

This application is a continuation of Ser. No. 08/023,836, filed Feb. 23, 1993, now abandoned.

FIELD OF THE INVENTION

This invention relates generally to the field of plumbing fittings and in particular to plumbing fittings that are used in association with water closets or toilets to join the water closet or toilet to a waste water drain pipe.

BACKGROUND OF THE INVENTION

Water toilets or water closets have a water storing receptacle, called a water tank, which is attached to a toilet bowl. Periodically, waste is removed from the toilet bowl by flushing, in which water is allowed to drain from the tank through the bowl and into a waste pipe. In order to work however the toilet bowl must be connected to the waste pipe by fluid carrying conduits. Typically the toilet will sit flat on the floor and connect with a water closet outlet flange. The water closet outlet flange in turn connects with conduits leading to the waste water drain.

Typically such a toilet flange includes a conduit portion for passing the waste fluids through the floor upon which the toilet sits, a number of openings to fasten the flange to the floor, and other openings to attach the toilet bowl to the flange itself. Additionally, there may be an appropriate seat for a toilet seal which typically may be made either from wax or relatively high-density foam.

Toilets are located in the bathroom in accordance with interior decorating aesthetics of the bathroom. The location of the toilet will of course determine the location of the toilet bowl discharge and hence the outlet flange. However, in making openings through floors there is some likelihood that the toilet bowl opening will be in an awkward or inconvenient place. An example would be where the toilet discharge opening is directly above a floor beam. To overcome such problems there have been provided, in the past, offset flanges for toilet bowls. An example of such an offset flange is U.S. Pat. No. 3,967,836 which issued on Jul. 6, 1976 to Lewis B. Izzi Sr.

This prior offset flange attempts to overcome the problems associated with positioning of the toilet bowl outlet pipe by positioning the conduit at one end of the flange adjacent one lateral edge of the flange. In this way, the toilet bowl outlet pipe can be positioned adjacent to a beam or tight against a wall or other obstacle without much inconvenience.

However, a problem with this prior device is that even though it provides some flexibility in close positioning of the fall conduit of the flange itself adjacent to a floor beam, because the outlet of the fall conduit is straight down, there is only limited flexibility. For example, such prior fittings maximum offset of one and a half or one and three quarter inches which cannot be exceeded. Further, any horizontal offset to the waste pipe requires a fall length, (typically ¼ per foot) thus the low point of the outlet below the flange is magnified as a function of distance. Finally, it can be difficult and awkward to secure connector elbows to the outlet conduit if it is cramped against a floor joint.

BRIEF SUMMARY OF THE INVENTION

Accordingly, what is desired is an outlet flange which is easily adjustable to accommodate close positioning adjacent to walls, or to floor beams or other sub-floor obstacles.

Preferably such an outlet flange would also provide easy connection to a conduit system for carrying flushed waste water to a waste water pipe.

According to the present invention there is provided a closet flange for connecting an outlet of a toilet bowl with a waste water drain conduit, the closet flange comprising:

an outer flange having an upper surface and a lower surface and having;

at least two generally opposed first apertures which extend through said flange between the upper surface and the lower surface for retaining fasteners for securing the flange to an underlying surface, wherein at least a portion of the lower surface lies against said underlying surface, and at least two second apertures extending from said lower surface to said upper surface for retaining fasteners connecting said flange to said toilet bowl, wherein at least a portion of said upper surface corresponds to said toilet bowl to allow said flange connector to be sealed to said toilet bowl; and a discharge tube extending from the seat at an angle to said underlying surface and having an outlet at said angle for connecting to the waste water drain conduit.

BRIEF DESCRIPTION OF THE DRAWINGS

Reference will now be made to the following drawings which depict preferred embodiments of the present invention by way of example only and in which.

DETAILED DESCRIPTION OF PREFERRED EMBODIMENT

Figure 1A:
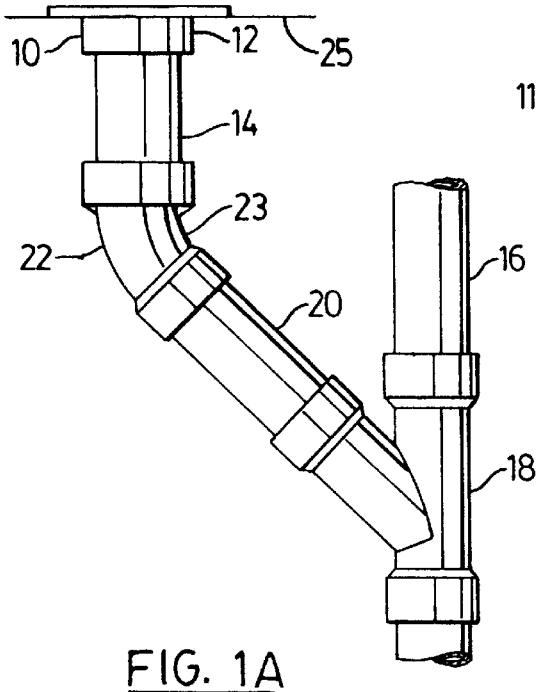
FIG. 1A (PRIOR ART)
FIG. 1A is a view of an outlet flange assembly according to the prior art.

FIG. 1A shows the configuration, typically used prior to this invention which illustrates the problems of the prior methods and assemblies. In FIG. 1A an outlet conduit 10 of a water closet flange 12 is shown. The outlet conduit 10 is straight and usually has an internal cuff for attachment to other conduits or fittings. In order to connect the vertical outlet flange 10 with the waste pipe shown at 16 in FIG. 1A, it is necessary to include a Y-fitting 18 in the waste pipe 16. Then, three additional fittings are required, namely, a straight portion 14, a straight portion 20 and an elbow 22 to make a fluid tight connection between the outlet conduit 10 and the waste pipe 16.

Figure 1B:
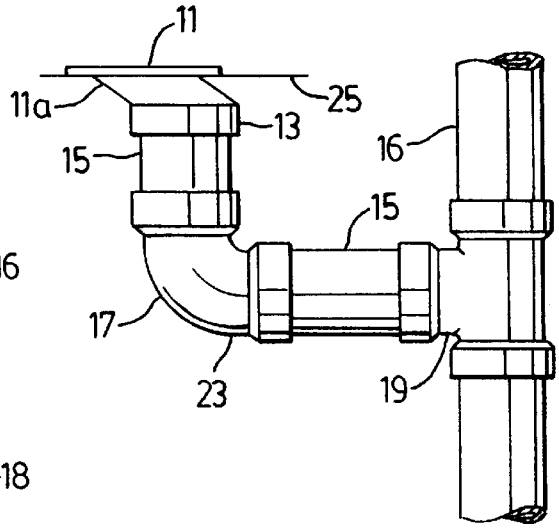
FIG. 1B (PRIOR ART)
FIG. 1B is a view of an offset outlet flange assembly according to the prior art.

FIG. 1B shows a typical connection with an offset flange, shown at 11. The offset flange 11 has a vertical outlet 13, which feeds into a straight conduit 15 an elbow 17 which in turn, through a second straight conduit 15 connects to a T-connector 19 in the waste pipe 16. The offset flange 11 includes a ramped offset portion 11*a* which deflects waste laterally to the vertical outlet 13.

As will be understood by those familiar with toilet installation, the direct vertical outflow of the outlet conduit 10, 11 requires a clear space below the toilet bowl exit. Thus, in the past, even where positioning of the toilet was desirable in one position, it may have been necessary to adjust the toilet laterally by the thickness of a floor beam in order to overcome the problems of the vertical outflow conduit 10. Additionally, considerable effort is required in making and securing the joints at either ends of the elbows 15, 22 and the straight conduit 17, 20. Finally, the downward extension outlet conduit 10 imposes a limitation on how close the corner 23 can be to the floor, shown at 25. This requires a lower ceiling, in any finished room under the bathroom.

Figure 2:
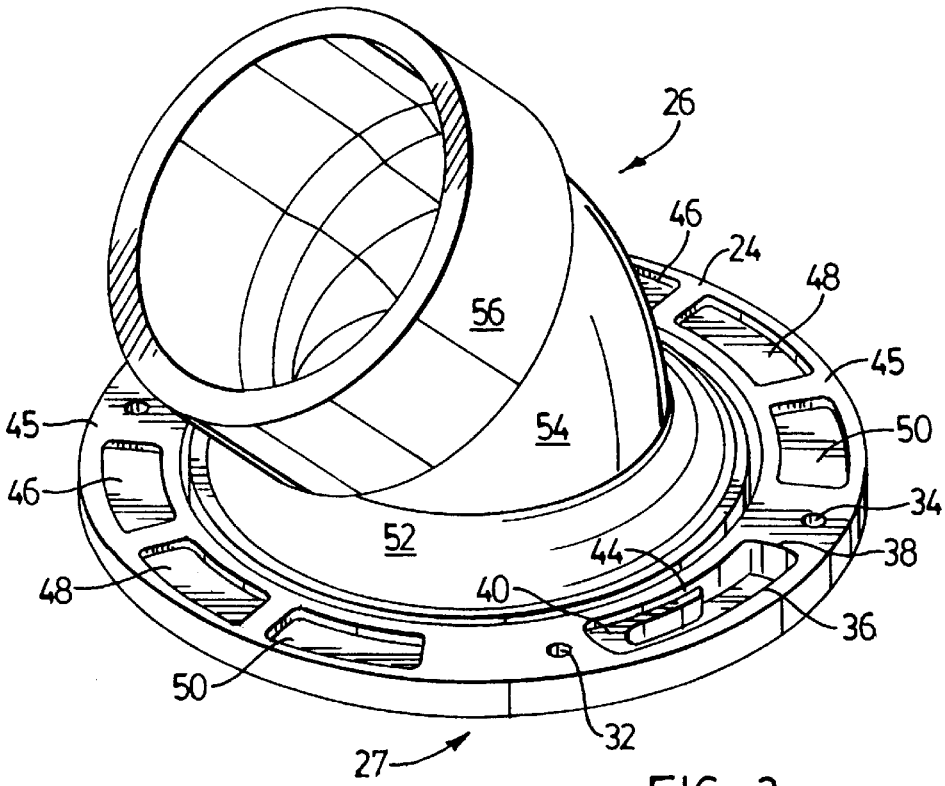
FIG. 2 is a view of an outlet flange assembly according to the present invention.

FIG. 2 shows an outlet flange assembly according to the present invention. Essentially, the closet flange is divided into two main components, namely an outer flange or rim 24 and a main body 26. As can be seen from FIG. 4, the outer flange 24 has an upper surface 27 into which a number of openings are formed as herein described, and a lower surface 28.

On opposite sides of the outer flange 24 are formed fastener retaining holes 32 and 34. Located between the fastener retaining holes 32 and 34 is a toilet bowl fastening aperture 36. The toilet bowl fastening aperture 36 comprises a two-part slot which includes a wide opening 38 at one end which narrows to a narrow opening 40 at the other end. The configuration of the toilet bowl fastening aperture is for the purpose of allowing a head of a fastening means, such as a bolt, to be passed through the wider opening 38. The neck of the bolt may then be slid into the narrow portion 40 securing the head beneath the narrow portion 40. By passing a threaded end of the bolt through a rim of a toilet, and fastening a nut thereto, the toilet bowl can be drawn down onto the flange and thus the toilet bowl can be securely attached to the flange. It will be noted that there is a space 44 between the bottom of the narrow portion and the bottom surface of the outer flange to allow the head of the bolt to slide under the narrow portion.

Also shown in the outer flange 24 are material saving openings 46, 48 and 50. These material saving openings allow ribs to be formed in the flange for strength, without requiring full amount of material. The remainder of the flange on the lower side 45, lies in a plane, to provide a good seat against the bathroom floor.

The main body 26 of the closet flange includes an outer rounded portion 52 which is the outside of the toilet bowl seal seat. A curved conduit section 54 extends outwardly from the section 52 and ends in a conduit receiving flange 56.

Figure 3:
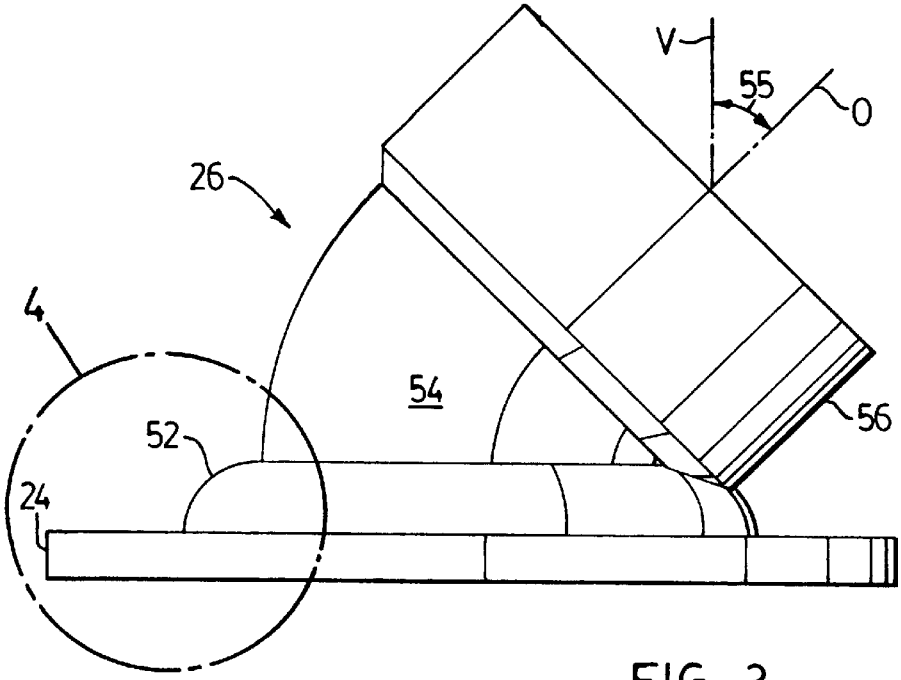
FIG. 3 is a side view of the outlet flange of FIG. 2.

As shown in FIG. 3, the present invention results in an out flow connection to a toilet out flow pipe on an axis 0, wherein angle 55 equals 45° to vertical (shown by line V). In FIG. 3, V is an axis parallel to the central axis of the toilet seal seat, displaced as shown for ease of understanding.

Figure 4:
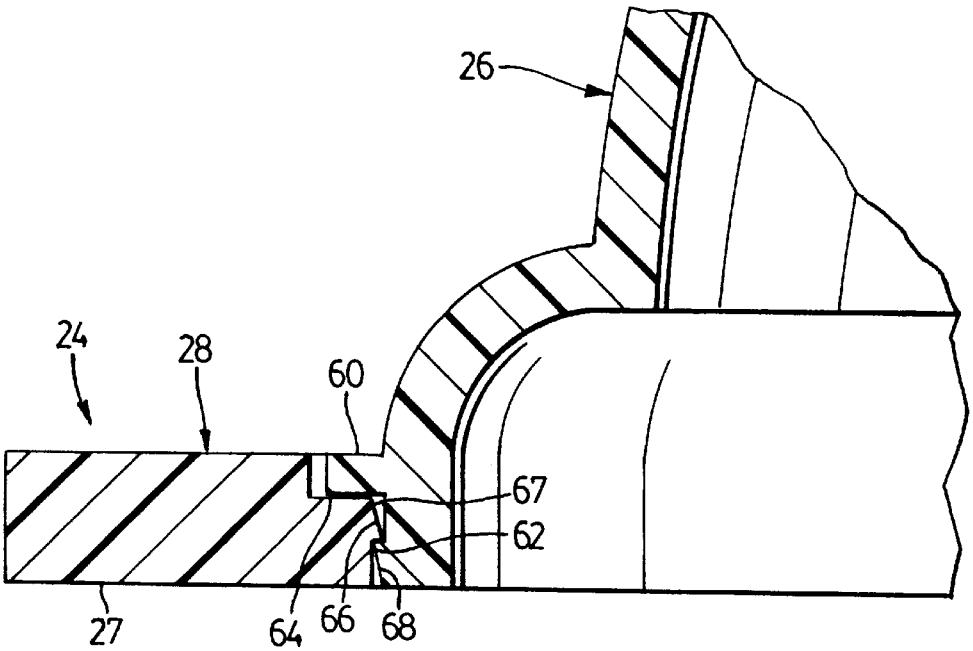
FIG. 4 is a cross sectional view of part of the assembly of FIG. 3.

As shown in FIG. 4, it is preferable that the outer flange 24 be rotatably connected to the main body 26 by means of an overlap. This means that the outlet pipe or main body is positionable to any degree of rotation relative to the flange to allow it to be positioned adjacent to or around any obstacle under the floor 25 in the sub-floor.

FIG. 4 shows one form of overlap that has been satisfactory. The main body 26 is formed with a stop rim 60, and a catch lip 62. In turn, the outer flange 24 is formed with a stop rim seat 64 and a mating catch 66. The outer flange 24 is formed with a stop rim seat 64 and a mating catch 66. The outer flange 24 can be pressed into place on the main body 26 in a simple and easy operation. Angled surfaces 67 and 68 respectively come into contact as the outer flange is pushed onto the main body, and then as the mating catch lips 64, 66 clear, the rim is secured onto the main body. The stop rim 60 then rides on the stop rim seat 64 to allow the main body to be positioned as desired with respect to the outer rim. This allows for a maximum ease of use, since the fasteners can be positioned optimally, and then prior to the toilet being secured to the flange, the outlet can be optionally positioned.

Figure 5:
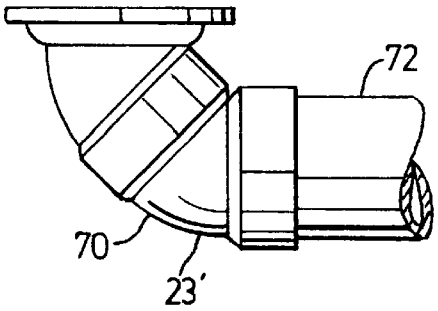
FIG. 5 is a view of the outlet flange of FIG. 2 assembled into a 90° bend configuration.

FIG. 5 shows the toilet flange of the present invention connected to a second 45° fitting 70 which is in turn connected to an outflow conduit 72. In this configuration, with two fittings, a horizontal outflow run can be formed.

Figure 6:
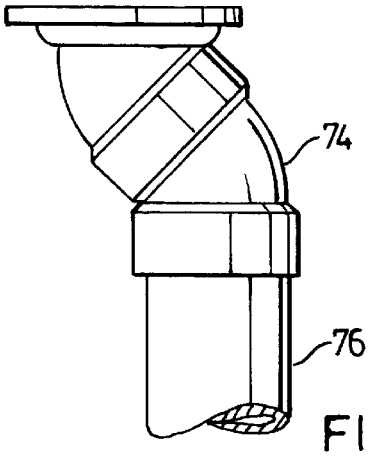
FIG. 6 is the outlet flange FIG. 2 assembled into an offset position.

In FIG. 6, the present invention is shown in an offset configuration in which the fitting is attached to a second 45° joint 74 and an outflow conduit 76. In this manner, the fitting can be positioned around any subgrade obstacles.

Figure 7:
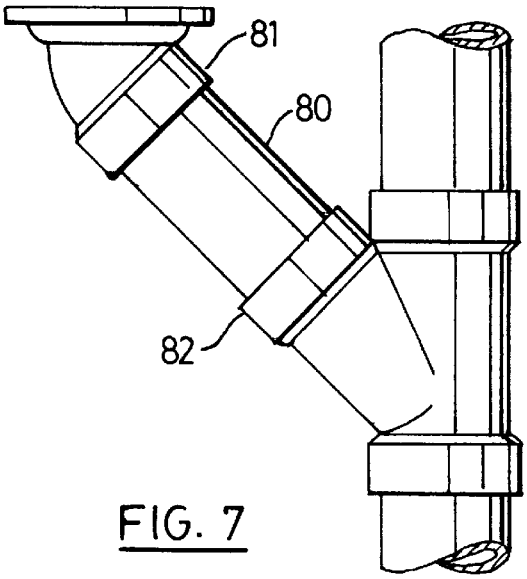
FIG. 7 is the flange of FIG. 2 assembled with a direct run into the waste pipe.

Finally, FIG. 7 shows the fitting of the present invention connected directly to a waste pipe through the use of a single straight conduit section 80. Because only two joints are required shown as 81 and 82, the installation as shown in FIG. 7 is quick and easy reducing expense and time of installation.

It can now be appreciated how the instant invention provides additional flexibility. In the configuration of FIG. 5, there is provided a lower corner 23' which is higher than in the prior art, by as much as 3 inches, yielding an additional 12 feet of horizontal run at a fall of ¼ per foot. Alternatively, this higher location of 23' might permit smaller boards to be used in the floor construction (2×6 rather than 2×10 or the like) saving on materials. In the configuration of FIG. 6 it can be appreciated how the swivelling between the outer flange and the main body adds flexibility. For example, instead of being fixed at a set amount of offset as shown in the prior art of FIG. 1B, the main body can be swivelled relative to the outer flange to yield anywhere from zero to a predetermined maximum amount of offset. This maximum is preferred to be around one and one and three quarters of an inch, but can be varied to suite the particular circumstances. Finally, it will be noted that the curved body portion provides a smooth transition between the vertical outflow and the angled outlet of the closet flange, which smooth transition inhibits plugging which could otherwise occur. A curved body is thus preferred to an angled body as shown in the prior art.

It will be appreciated by those skilled in the art that the present invention has been described with respect to particular preferred embodiments and that other configurations of the invention are possible without departing from the scope of the instant invention. For example, while the instant invention is described with respect to a 45° bend in the conduit other angles may also be used without significantly departing from the scope of the instant invention. In particular, a 45° angle is convenient because another 45° angle fitting allows the outflow to run either generally horizontal (FIG. 5) or vertical (FIG. 6). However, if a 30° angle were chosen, the same effect could be achieved by using a complementary 60° angled fitting.

I claim:

1. A closet flange for connecting an outlet of a toilet bowl with a waste water drain conduit through an opening in a floor, the closet flange comprising:

an outer flange having an upper surface and a lower surface and having at least two generally opposed first apertures which extend through said outer flange between the upper surface and the lower surface and which are adapted for retaining fasteners for securing the outer flange to a floor, wherein at least a portion of the lower surface is adapted to lie against said floor, and at least two second apertures extending from said lower surface to said upper surface and which are adapted for retaining fasteners connecting said outer flange to a toilet bowl; and a discharge tube rotatably connected to the outer flange, wherein said outer flange is rotatably connected to said discharge tube by a press catch connector, and wherein said press catch connector permits rotation of said discharge tube relative to said outer flange without raising or lowering of said discharge tube relative to said outer flange, said discharge tube including:

an interiorly-positioned seal seat located proximate said outer flange, said seat having an inner diameter which defines a first substantially circular opening;

a distal end for coupling to said waste water drain conduit; and a continuously curved non-edge bearing tubing section extending between said first substantially circular opening and said distal end to provide a smooth edge-uninterrupted transition therebetween thus sweeping discharge into said waste water drain conduit without clogging, said tubing section defining a curved centerline immediately below and continuously from said first substantially circular opening whereby a vertical distance between said distal end and said flange is minimized.

2. The closet flange of claim 1 wherein said closet flange is two piece flange and said outer flange comprises one piece and said discharge tube comprises a second piece.

3. The closet flange of claim 1 wherein the angle between the floor and the curved discharge tube is between 15 and 75 degrees.

4. The closet flange of claim 1 wherein the angle between the floor and the discharge tube is between 30 and 60 degrees.

5. The closet flange of claim 1 wherein the angle between the floor and the discharge tube is 45 degrees.

6. The closet flange of claim 1 wherein the closet flange is moulded from thermal plastic.

7. The closet flange of claim 1 wherein the seat is circular in plan and inwardly curved in profile.

8. The closet flange of claim 1 wherein the press catch connector comprises a mating catch lip and stop rim on the tube and a mating catch and stop rim seat on the outer flange.

9. A closet flange for connecting an outlet of a toilet bowl with a waste water drain conduit through an opening in a floor, the closet flange comprising:

an outer flange having an upper surface and a lower surface and having at least two generally opposed first apertures which extend through said outer flange between the upper surface and the lower surface and which are adapted for retaining fasteners for securing the outer flange to a floor, wherein at least a portion of the lower surface is adapted to lie against said floor, and at least two second apertures extending from said lower surface to said upper surface and which are adapted for retaining fasteners connecting said outer flange to a toilet bowl; and a discharge tube rotatably connected to the outer flange, wherein said outer flange is rotatably connected to said discharge tube by a press catch connector, and wherein said press catch connector permits rotation of said discharge tube relative to said outer flange without raising or lowering of said discharge tube relative to said outer flange, said discharge tube including:

an interiorly-positioned seal seat located proximate said outer flange, said seat having an inner diameter which defines a first substantially circular opening;

a distal end for coupling to said waste water drain conduit; and a curved tubing section extending between said first substantially circular opening and said distal end, said tubing section defining a curved centerline immediately below and continuously from said first substantially circular opening whereby a vertical distance between said distal end and said flange is minimized.

* * * * *